United States Patent [19]

Yagi et al.

[11] Patent Number: 4,709,678

[45] Date of Patent: Dec. 1, 1987

[54] UNCERTAINTY DETECTOR IN FEED-BACK CONTROL SYSTEM BASED ON COMBUSTION PEAK POSITION DATA FOR INTERNAL COMBUSTION ENGINE AND IGNITION TIMING CONTROL HAVING PARTICULAR DETECTOR

[75] Inventors: Shizuo Yagi, Asaka; Makoto Kawai, Tokorozawa; Yorihisa Yamamoto, Shiki, all of Japan

[73] Assignee: Honda Giken Kogyo Kabushiki Kaisha, Tokyo, Japan

[21] Appl. No.: 868,592

[22] Filed: May 30, 1986

[30] Foreign Application Priority Data

May 31, 1985 [JP] Japan ..... 60-117769
Aug. 9, 1985 [JP] Japan ..... 60-175179

[51] Int. Cl.[4] ..... F02P 5/145
[52] U.S. Cl. ..... 123/425; 73/115
[58] Field of Search ..... 123/425, 435; 73/35, 73/115

[56] References Cited

U.S. PATENT DOCUMENTS

| | | | |
|---|---|---|---|
| 3,957,023 | 5/1976 | Peterson | 123/425 |
| 4,190,027 | 2/1980 | Inui et al. | 123/416 |
| 4,211,194 | 7/1980 | Hattori et al. | 123/425 |
| 4,328,779 | 5/1982 | Hattori et al. | 123/425 |
| 4,397,285 | 8/1983 | O'Neill | 123/502 |
| 4,406,265 | 9/1983 | Brandt et al. | 123/425 |
| 4,417,556 | 11/1983 | Latsch | 123/425 |
| 4,466,408 | 8/1984 | Cheklich | 123/425 |
| 4,481,925 | 11/1984 | Karan et al. | 123/425 |

*Primary Examiner*—Andrew M. Dolinar
*Attorney, Agent, or Firm*—Birch, Stewart, Kolasch & Birch

[57] ABSTRACT

In a feed-back engine control system in response to an indicative pressure signal representing the inner pressure of the combustion chamber of an internal combustion engine, uncertain states are detected by comparing peak positions appearing in the respective ones of the indicative pressure signal and the filtered indicative pressure signal, thereby to avoid unfavorable operation of the system.

13 Claims, 26 Drawing Figures

TDC
(RESET)
PK
0
1
2
3
4
5
6
7
8
9
63
64
0
2
4
5
5

TDC RESET
NP

UNCERTAINTY DETECTOR IN FEED-BACK CONTROL SYSTEM BASED ON COMBUSTION PEAK POSITION DATA FOR INTERNAL COMBUSTION ENGINE AND IGNITION TIMING CONTROL HAVING PARTICULAR DETECTOR

FIELD OF THE INVENTION

The present invention relates to a feed-back control system for controlling an internal combustion engine in response to a combustion peak position signal representing a crank angle position at which the maximum peak pressure appears in the combustion chamber of the engine.

BACKGROUND OF THE INVENTION

It is possible to obtain the so-called indicative pressure signal representative of the inner pressure of the combustion chamber of an internal combustion engine by providing a pressure sensor such as a piezo-electric element in a bore formed through a member forming the combustion chamber of the engine such as a cylinder head. A pressure gauge may be otherwise interposed between the cylinder head and the cylinder block of the engine, which functions as the pressure sensor for producing the indicative pressure signal.

It will be seen that the internal pressure in the combustion chamber under operation of the engine changes as indicated by a curve A in FIG. 1. When the ignition system of the engine is triggered at an ignition angle $\theta$IG, the air-fuel mixture supplied thereto starts firing with a time delay of $\theta$d and, subsequently, the internal pressure rapidly increases up to a maximum pressure peak (referred to as an indicative pressure peak hereinafter) and then decreases.

It is known that a crank angle position of the indicative pressure peak has a certain relationship with the state of the engine at which the maximum output is produced, and the indicative pressure peak giving the maximum engine output has been found, by experiment, to be located between 12 to 13 degrees after the top dead center (referred to as ATDC hereinafter) as shown in the drawings. Therefore, ATDC 12 to 13 degrees may be considered as an ideal crank angle region. It is therefore desirable to determine the ignition timing $\theta$IG so that the indicative pressure peak occurs within the ideal crank angle region which is ATDC 12 to 13 degrees.

A feed-back ignition timing control system is disclosed in U.S. Pat. No. 4,481,925 issued Nov. 13, 1984. The feed-back ignition timing control system controls the ignition timing of an internal combustion engine in response to the indicative pressure signal to keep the indicative pressure peak position within an optimum region. In this prior art system, contamination of the indicative pressure signal by high frequency noises is ignored by providing a gating function for taking the indicative peak information only during a predetermined crank angle region or zone. The particular crank angle zone is defined by timing pulses generated by a pulse generator including a toothed wheel and a pickup for producing a timing pulse at each time of the passage of the teeth before it. The teeth are mounted on the periphery of the wheel equidistantly such as 60 degrees.

It has been revealed that such a gating function is still insufficient for avoiding unfavorable operations of the system which should be caused by uncertain states either of the engine such as the so-called knocking state or of the feed-back control system per se. The uncertain state of the feed-back system may occur due to external mechanical and electric noises or troubles in the inner pressure sensor.

Such problems as mentioned above may have been encountered in various feed-back control systems responsive to the indicative pressure signal other than the ignition timing control system, such as a fuel injection control system for a diesel engine. In this fuel injection system, the fuel injection timing is regulated in accordance with the peak position information obtained from the indicative pressure signal. Another feed-back control system based on the indicative pressure signal is an automatic transmission control system which controls its operational mode in response to the indicative pressure signal.

SUMMARY OF THE INVENTION

It is therefore a primary object of the invention to provide an uncertainty detector in a feed-back control system based on the indicative pressure signal for an internal combustion engine, which produces an uncertainty detection signal usable for various protective operations for the feed-back control system or for an alarm.

It is another object of the present invention to provide an ignition timing control system for an internal combustion engine which can avoid unfavorable operation even in the face of those uncertain states of the engine.

Further objects and advantages of the present invention will be apparent from the following description and the accompanying drawings.

DETAILED DESCRIPTION OF EMBODIMENTS

Figure 2:
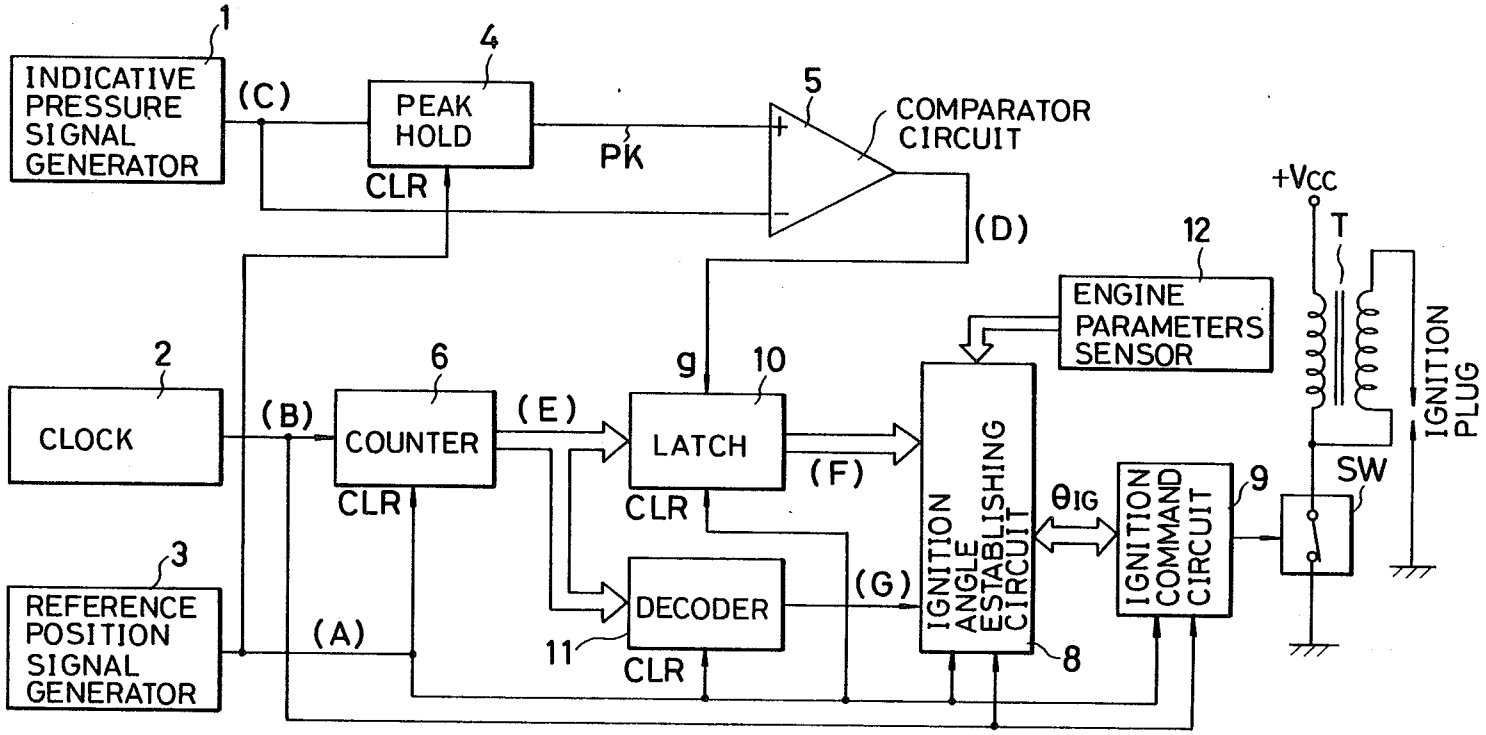
FIG. 2 is a circuit diagram showing an ignition timing control system disclosed in a co-pending application.

FIG. 2 shows an ignition timing control system disclosed in a co-pending application assigned to the same Assignee as the present application. The system comprises an indicative pressure signal generating circuit 1 which generates an indicative pressure signal by using pressure sensor which may include a piezo-electric element and is inserted into a bore provided through a member such as a cylinder head which defines a combustion chamber of an internal combustion engine in such a manner that the detection head of the pressure sensor is exposed to the interior of the combustion chamber. A clock generating circuit 2 produces clock pulses in synchronism with the rotation of the engine. Means for obtaining clock pulses which are in synchronism with the rotation of the engine may consist of a disc which rotates in synchronism with the engine and has a plurality of slits in combination with a photo-coupler in such a manner that the clock pulses may be obtained from the output signal of the photo-coupler. A reference position generating circuit 3 produces a reference position signal, for example a TDC (Top Dead Center) pulse, which indicates that the crank angle position or the engine rotational angle position has reached a reference position. The TDC pulse may be obtained by providing a separate slit for TDC pulses in the disc which is already provided with the slits used for the clock generating circuit 2, in combination with a photocoupler for generating TDC pulses. A peak hold circuit 4 holds the maximum value of the indicative pressure signal after it is cleared by the reference position signal. A comparator circuit 5 produces a peak detection signal when the indicative pressure signal has fallen below its maximum value kept by the peak hold circuit 4. A counter 6 for measuring the crank angle position counts the number of the clock pulses and is reset by the reference position signal. The count value of the counter 6 which may be 8-bit data indicates the current value of the crank angle. A latch circuit 10 latches the count value of the counter 6 every time the peak detection signal from the comparison circuit 5 is supplied to the gate terminal g of the latch circuit 10, while a decoder 11 supplies a read-in command signal to an ignition angle establishing circuit 8 when the count value of the counter 6 reaches a predetermined value, for instance "63". The count value of "63" corresponds to a crank angle which is greater than any crank angle at which the indicative pressure peak is expected to occur, and the read-in timing is so selected that it will not be interfered with by noises such as the combustion noises and the valve seating noises caused by the operation of the inlet and/or exhaust valves. The ignition angle establishing circuit 8 accordingly reads out or takes the contents of the latch circuit 10 and determines the indicative pressure peak position datum $\theta_{px}$ from the contents of the latch circuit 10. It is also possible to use a structure according to which the contents of the latch circuit 10 are supplied to the ignition timing establishing circuit 8 by way of a gate circuit which opens its gate by a read-in command signal from the decoder 11. The ignition angle establishing circuit 8 may consist of a microprocessor and supplies a desired ignition angle $\theta_{IG}$ data to an ignition command circuit 9 according to a program, which is described hereinafter, and the peak position information (data) supplied thereto. The ignition command circuit 9 detects the current value of the crank angle $\theta_{ig}$ by counting the clock pulses and using the reference position signal as a reference, and closes an ignition switch SW when the current crank $\theta_{ig}$ and the input $\theta_{IG}$ coincide with each other, whereby ignition current is passed through the primary winding of an ignition transformer T and a spark ignition takes place at an ignition plug. Accordingly, the desired ignition angle $\theta_{IG}$ is a next-cycle ignition angle datum for governing the actual ignition during the next engine cycle succeeding to the engine cycle having caused the appearance of the indicative pressure peak $\theta_{px}$ the ignition angle establishing circuit 8 and the ignition command circuit 9 form the ignition command means. The ignition angle establishing circuit 8 may be equipped with a mode in which the ignition angle establishing circuit 8 operates according to various parameter, such a rotational speed of the engine Ne, intake negative pressure $P_B$, throttle opening $\theta_{th}$ and so on, obtained from engine parameter sensors 12.

Figures 3A, 3B, 3C, 3D, 3E, 3F, 3G:
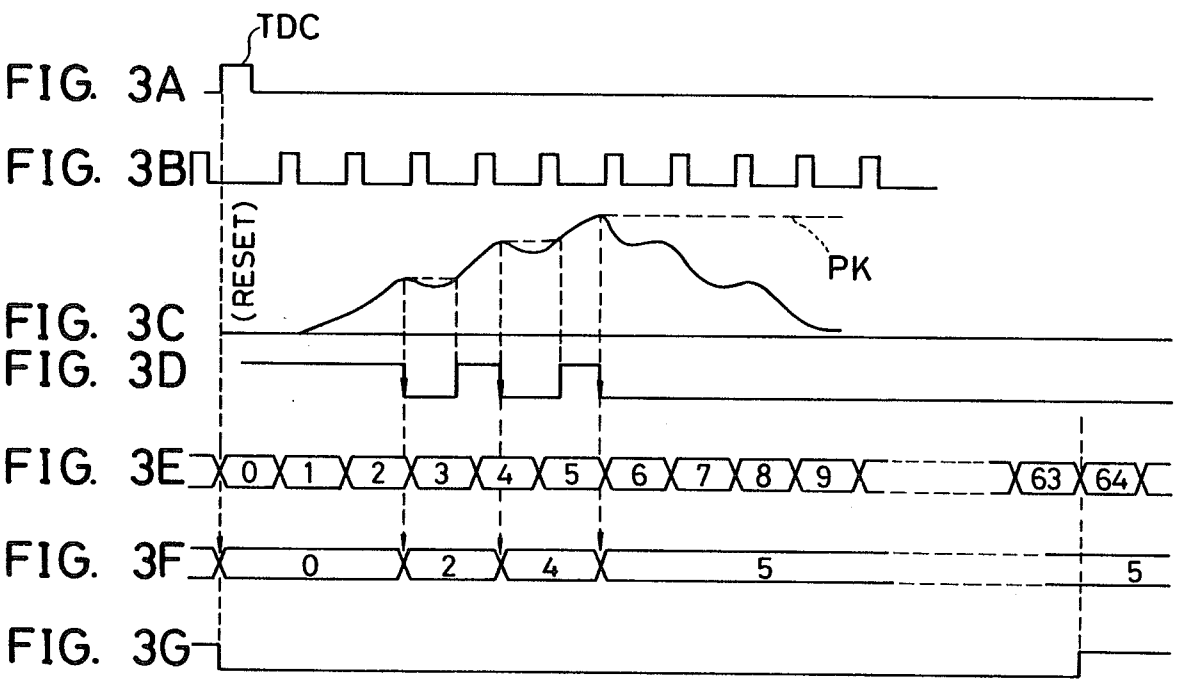
FIGS. 3A through 3G are diagrams illustrating waveforms of signals appearing in the circuit of FIG. 2.

FIGS. 3A to 3F show signal waveforms for illustrating the actions of the above-described circuits. Specifically, the reference position signal and the clock pulses appear as shown in FIGS. 3A and 3B, respectively. The indicative pressure signal changes in such a manner as shown by a solid line in FIG. 3C and the output of the peak hold circuit 4 therefore changes in such a manner as shown by the dotted line in FIG. 3C. The comparator circuit 5 produces a peak detection pulse signal upon detection of every local maximum of the indicative pressure signal as shown in FIG. 3D. FIG. 3E shows the changes of the count values of the counter 6 in decimal.

FIG. 3F shows the contents of the latch circuit 10 in decimal. FIG. 3G shows the changes in the output of the decoder 11 and, in this case, a higher level corresponds to the read-in command signal.

Figures 4A, 4B, 4C:
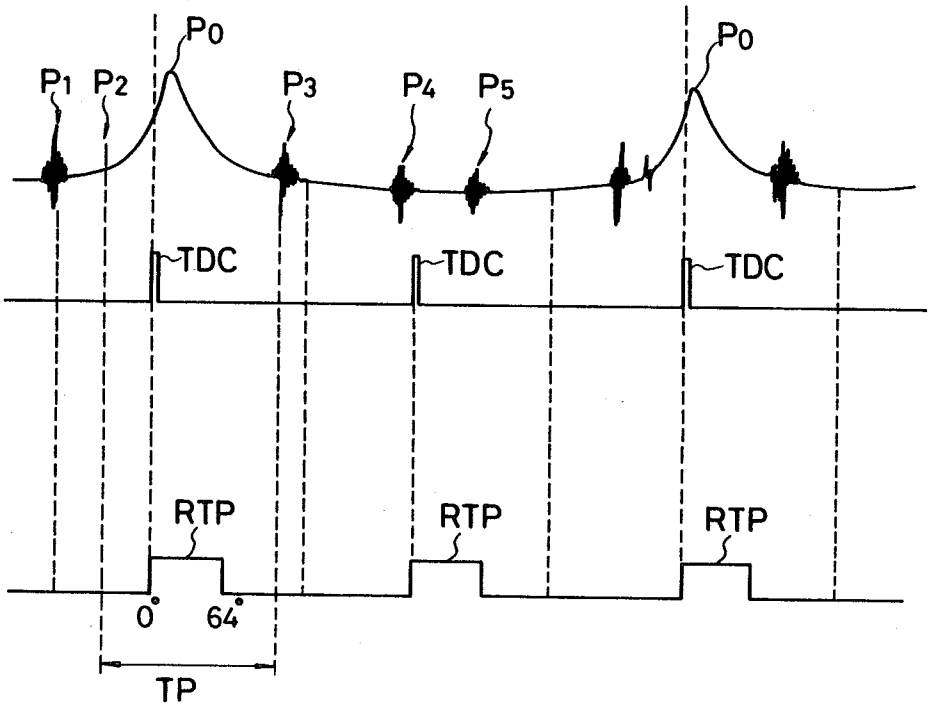
FIG. 4A is a diagram showing a waveform of the indicative pressure signal.
FIG. 4B is a diagram showing a waveform of TDC pulses.
FIG. 4C is a diagram showing gate timings for receiving the indicative pressure peak data.

FIG. 4A shows an example of waveform of the indicative pressure signal which contains maximum peak values $P_0$, valve seating noises $P_1$, $P_3$, $P_4$ and $P_5$, and an ignition noise $P_2$. FIG. 4B shows waveforms of the reference position pulses each appearing at the TDC. FIG. 4C shows that the ignition timing control system restrict the time period for picking up the maximum peak position information to a short time period RTP (0 degree to 64 degree), that is, from the TDC to the predetermined crank angle corresponding the decoding number of, in this embodiment, 63. The short time period RTP is contained within the time period from the ignition timing to the valve seating timing, so that the operation for picking up the maximum peak position information is not adversely affected by the ignition noises and valve seating noises etc.

Figure 1:
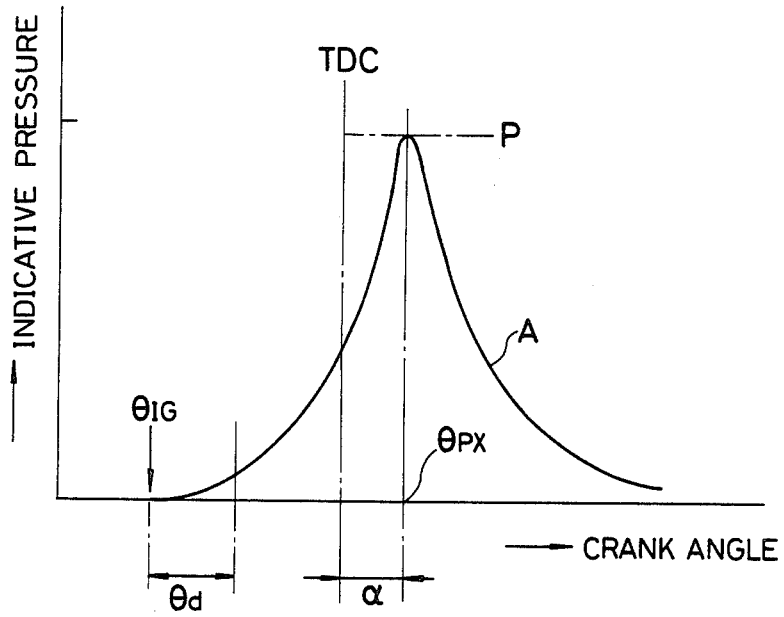
FIG. 1 is a graph showing the changes in the internal pressure of an engine cylinder.
Figure 5:
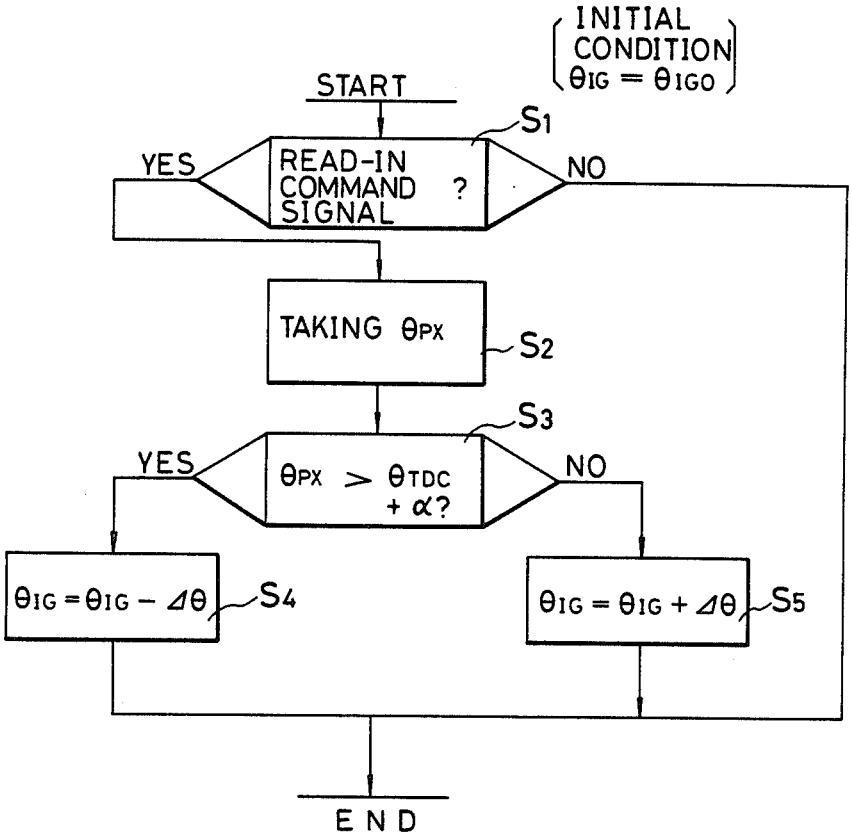
FIGS. 5 and 6 are flow charts describing basic action programs of the parts of the device of FIG. 2 made of a micro computer.

FIG. 5 shows an example of the program governing the ignition control operation of the ignition angle establishing circuit 8 of the system shown in FIG. 1 when the circuit 8 is made of a microprocessor. In performing the ignition control action, the ignition angle establishing circuit 8 initially establishes or determines the ignition angle $\theta_{IG}$ at an initial value $\theta_{IGO}$ and waits for the read-in command signal from the decoder 11, and, upon receipt of the read-in command signal, takes therein the latch contents of the latch circuit 10 as the peak position information $\theta_{px}$ (steps $S_1$ and $S_2$). Then, it is distinguished if the peak position information $\theta_{px}$ is greater than the sum of the top dead center angle $\theta_{TDC}$ and a certain angle $\alpha$, for instance 12 degrees, or not (step $S_3$). If $\theta_{px} > \theta_{TDC} + \alpha$, then the ignition angle $\theta_{IG}$ is advanced by $\Delta\theta$(step $S_4$) and, if not, the ignition angle $\theta_{IG}$ is delayed by $\Delta\theta$(step $S_5$). These actions from start to end, steps $S_1$ to $S_5$, are sequentially executed and cyclically repeated. This is the case with other programs which are referred to hereinafter.

Figure 6:
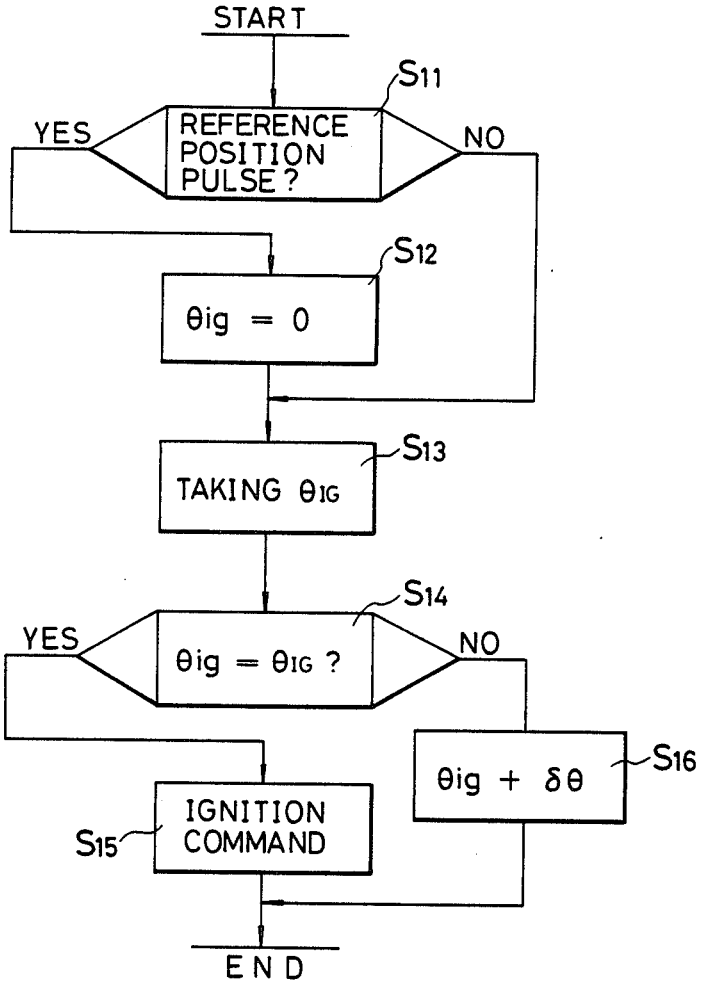

FIG. 6 shows an example of the action program of the ignition command circuit 9 when it is made of a micro-processor. When the ignition command circuit 9 detects the reference position signal (step $S_{11}$), the present value of the crank angle $\theta_{ig}$ is set to $\theta_{TDC}$ (or a predetermined value) (step $S_{12}$). Then, the ignition angle data $\theta_{IG}$ from the ignition angle establishing circuit 8 is taken in (in step $S_{12}$) and this data is compared with the present value of the crank angle $\theta_{ig}$. If the relationship $\theta_{ig}=\theta_{IG}$ holds, the ignition command is issued (steps $S_{14}$ and $S_{15}$) and the ignition switch SW is closed. On the other hand, if $\theta_{ig}$16 $\theta_{IG}$ holds, a unit angle $\delta\theta$ is added to the $\theta_{ig}$ (step $S_{16}$) and the program flow stands by for the next program cycle. It is also possible to determine whether the difference between the $\theta_{ig}$ and $\theta_{IG}$ is greater or smaller than $\delta\theta$, in ste $S_{14}$, instead of determining whether $\theta_{ig}=\theta_{IG}$ holds or not.

In the above-described embodiment, the peak position data $\theta_{px}$ was obtained in every engine cycle and the ignition angle for the next engine cycle is determined on the basis of the $\theta_{px}$ of the current engine cycle.

Figure 7:
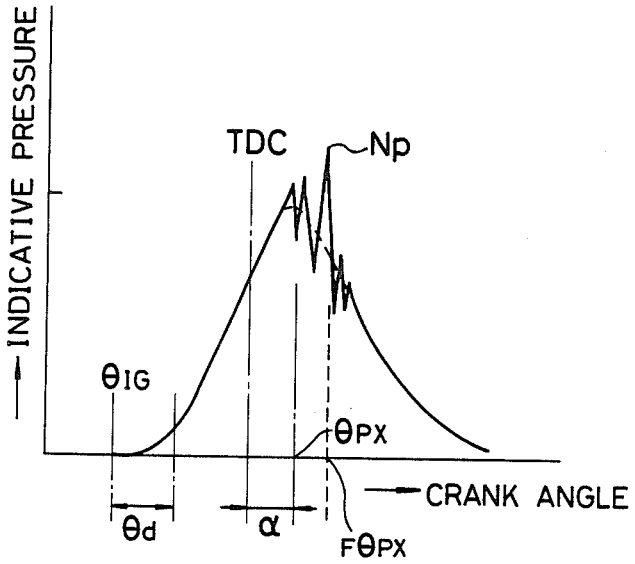
FIG. 7 is a diagram showing a waveform of the indicative pressure signal contaminated with noises appearing around the top dead center.

FIG. 7 shows a waveform of the indicative pressure signal which is contaminated by noises such as knocking noises or the external mechanical or electric noises. Those noises may occur during uncertain states of the engine. Troubles in the pressure detector per se may also cause such noises. Those noises appear around the top dead center and therefore the ignition timing control system described above will be adversely affected by the noises notwithstanding the gating function performed by the decoder 11 and so on.

Figure 8:
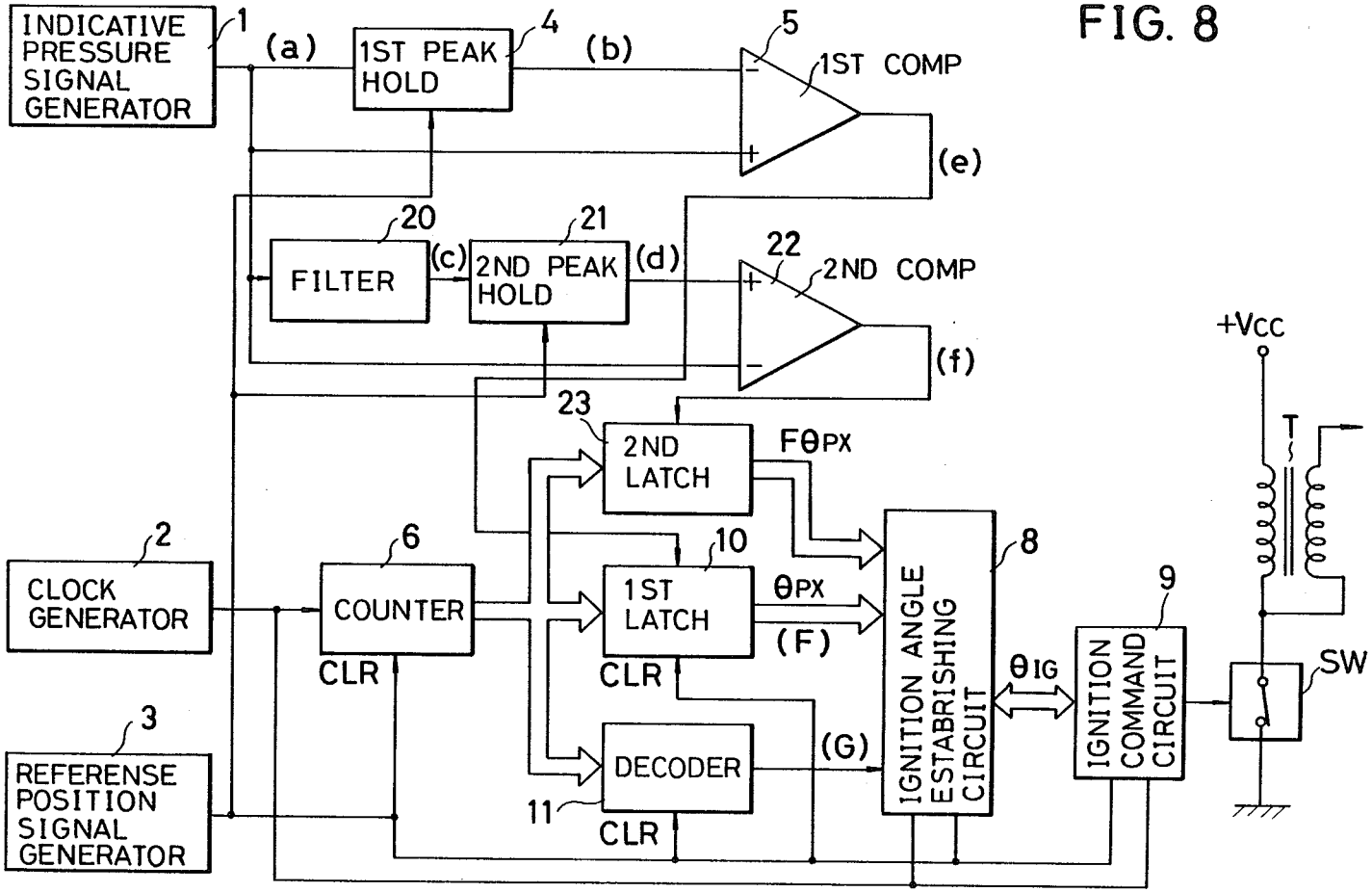
FIG. 8 is a circuit diagram showing an embodiment of the present invention.

FIG. 8 shows an improved ignition timing control system according to the present invention which includes the control system according to the present invention which includes an uncertainty detector for detecting an uncertain state of the engine so as to make possible to avoid erroneous operation of the system even in the face of such contamination to the indicative pressure signal mentioned above with reference to FIG. 7.

The ignition timing control system of FIG. 8 has the same construction as that of FIG. 2 except that the former includes the uncertainty detector of the present invention which includes a filter 20, a second peak hold circuit 21, a second comparator 22, a second latch circuit 23 and comparing means contained in the ignition angle establishing circuit 8. The comparing means is adapted to compare the latched content of the second latch circuit 22 with a latched content of a first comparator 5 so as to determine the uncertain state of the engine. The first comparator 5 corresponds to the comparator 5 of the system in FIG. 2. The first peak hold circuit 4 corresponds to the peak hold circuit 4 of the system of FIG. 2. The filter 20 may be a high cut filter or a low pass filter for eliminating such noises as shown in FIG. 7 from the indicative pressure signal.

When, in operation, the indicative pressure signal is contaminated by the noises NP as shown in FIG. 7, the first comparator circuit 5 produces a peak detection signal at a crank angle $\theta_{px}$ corresponding to the maximum peak formed by a peak of the noises NP. On the other hand, the input signal to the second peak hold circuit 21 is free from the noises NP and therefore the second comparator circuit 22 produces a peak detection signal at the angle $F\theta_{px}$ which is the inherent maximum peak of the indicative signal but somewhat delayed due to the property of the filter 20. Namely, the first latch circuit 10 produces a peak position datum $\theta_{px}$ and, on the other hand, the second latch circuit 23 produces a peak position datum $F\theta_{px}$ different from $\theta_{px}$ when the indicative pressure signal is contaminated in such manner as shown in FIG. 7.

Both the peak position data $F\theta_{px}$ and $\theta_{px}$ are compared with each other by comparing means formed by a program step executed by the ignition angle establishing circuit 8. A preferred program to be executed by the ignition angle establishing circuit 8 is shown in FIG. 9.

Figure 9:
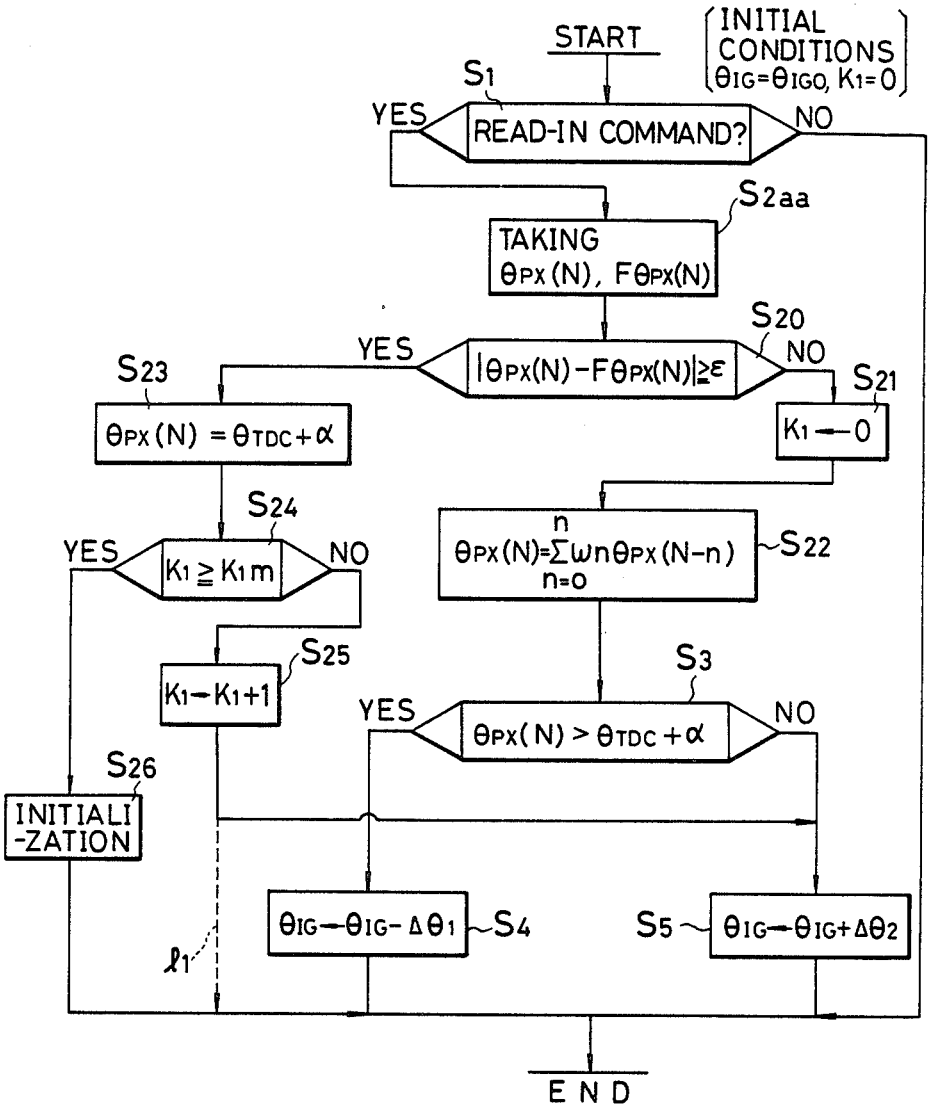
FIG. 9 is a flowchart showing a program to be executed by a part of the system shown in FIG. 8.

The program of FIG. 9 includes the same basic steps $S_1$, $S_3$, $S_4$ and $S_5$ as that of FIG. 5. However, this program FIG. 9 includes the step $S_{2aa}$ instead of the step $S_2$. In the step $S_{2aa}$, both the data $\theta_{px}(N)$ and $F\theta_{px}(N)$ are taken into the memory (not shown) such as RAM in the circuit 8 at an N-th engine cycle.

Then, a difference between the data $\theta_{px}(N)$ and $F\theta_{px}(N)$ is compared with a predetermined small value $\epsilon$ in a step $S_{20}$. When the difference is smaller than the value $\epsilon$, a parameter $K_1$ is set to "0" in a step $S_{21}$. In the next step $S_{22}$, the following calculation is made in order to enhance the stability of the feed-back system. That is, $$\theta_{px}(N) = \sum_{n=0}^{n} \omega n \theta_{px}(N-n)$$

As a concrete example, the current data may be derived from the average value of the four preceding data and the current data by setting $\omega_0=\omega_1=\omega_2=\omega_3=\omega_4=1/5$ and $\omega_5=\omega_6=\ldots=\omega_n=0$. The averaging method is not limited by this, but may be based on averaging of an arbitrary number of data. And, it is also possible to set $\omega_n=(1/L)^n$ (where $L>1$ and $n>0$).

The ignition angle advance and delay control may be made according to the thus derived results of comparison between $\theta_{px}$ and $(\theta_{TDC}+\alpha)$ (steps $S_4$ and $S_5$), but the angle advance $\Delta\theta_1$ and the angle delay $\Delta\theta_2$ need not be equal to each other but it may be that either $\Delta\theta>\Delta\theta_2$ or $\Delta\theta_1>\Delta\theta_2$ independent on the characteristics of the feedback system. Further, $\Delta\theta_1$ and $\Delta\theta_2$ may be functions of the difference between $\theta_{px}$ and $(\theta_{TDC}+\alpha)$.

When the difference between $\theta_{px}(N)$ and $F\theta_{px}(N)$ is equal to or less than $\epsilon$ then $\theta_{px}(N)$ is made equal to $\theta_{TDC}+\alpha$(step $S_{23}$). As long as $K_1<K_{1m}$ (step $S_{24}$), $K_1$ is set to equal to $K_1+1$ and an ignition angle delay control is conducted, and, if $K_1 \geqq K_{1m}$ by consecutive occurrence of uncertain states, and initialization step is conducted for resetting the ignition timing (step $S_{26}$). It is also possible not to conduct the ignition angle delay control and let the program flow advance to the next program cycle as indicated by the broken line $l_1$.

Figure 10:
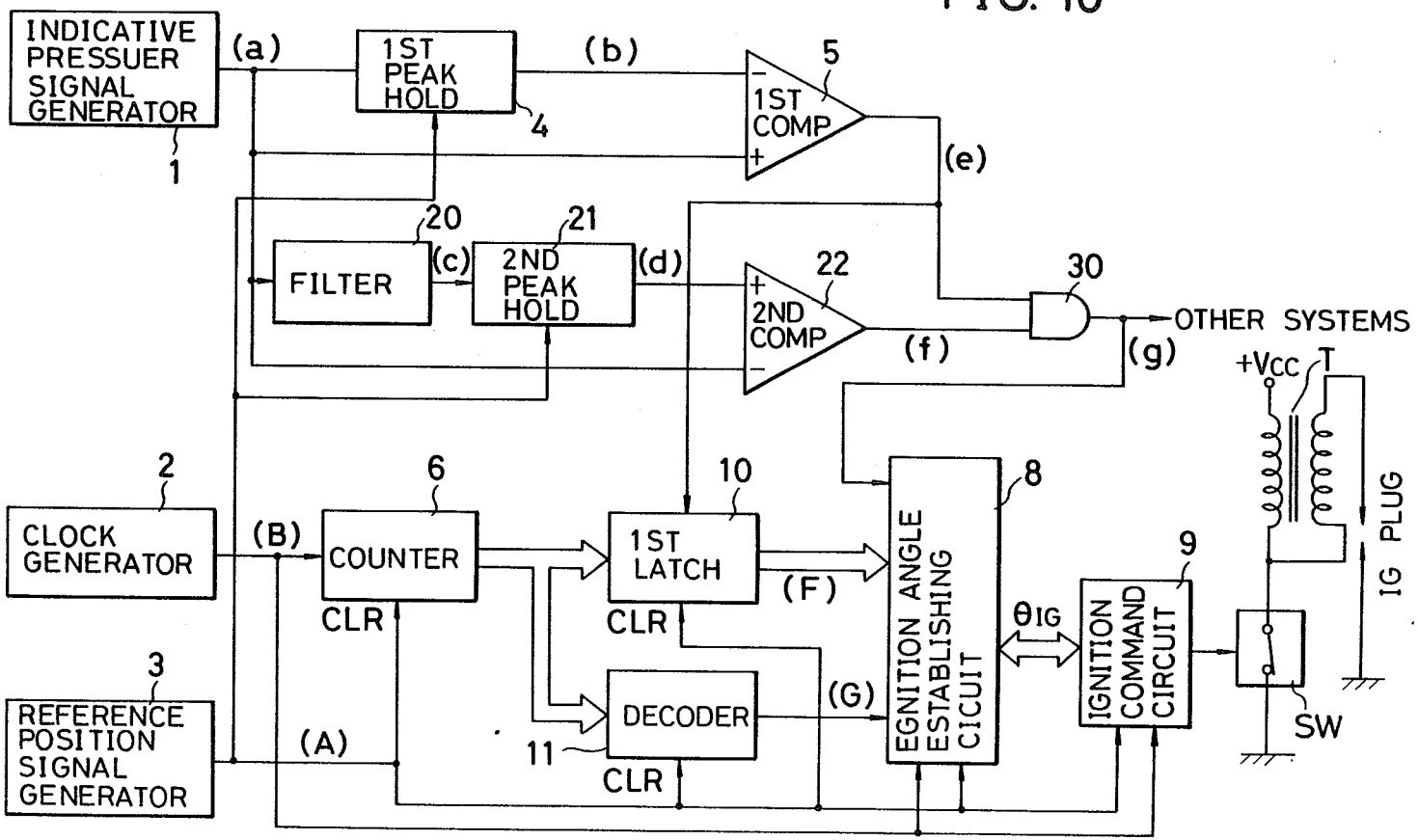
FIG. 10 is a circuit diagram showing another embodiment of the present invention.

FIG. 10 shows another embodiment of the present invention which has the same construction as that of FIG. 8 except that the former includes an AND gate 30 while eliminating the latch circuit 23. The output signal from the AND gate 30 is supplied to the ignition angle establishing circuit 8 and to another feed-back control system such as a fuel supply regulation system or an automatic transmission system. The output signal from the AND gate 30 is an NG signal representing an uncertain state of the engine or the control system per se. This NG signal may be used for triggering an alarm system.

Figures 11A, 11B, 11C, 11D, 11E, 11F, 11G:
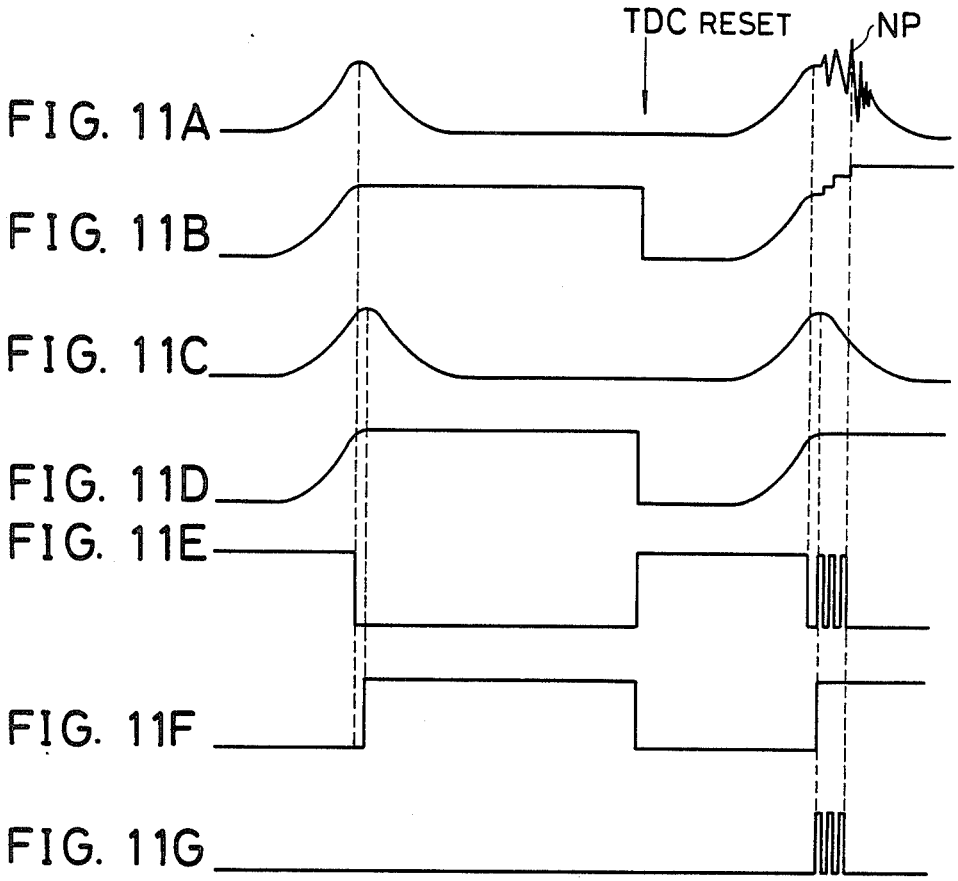
FIGS. 11A through 11G are diagrams respectively showing waveforms appearing in the circuit of FIG. 10.

When, in operation, the indicative pressure signal has such a waveform as shown in FIG. 11A, the output signal of the first peak hold circuit 4 has such a waveform as shown in FIG. 11B. As seen from FIG. 11B, the output signal of the peak hold circuit 4 has a peak level higher than the usual peak level of the indicative pressure signal. When the noises are eliminated by the filter 20, the indicative pressure signal must have such a waveform as shown in FIG. 11C and, therefore, the output signal of the second peak hold circuit 21 has such a waveform as shown in FIG. 11D. The output signals from the comparator circuits 5 and 22 respectively have such waveforms as shown in FIGS. 11E and 11F. Therefore the NG signal emitted from the AND gate 30 has such a waveform as shown in FIG. 11G.

Figure 12:
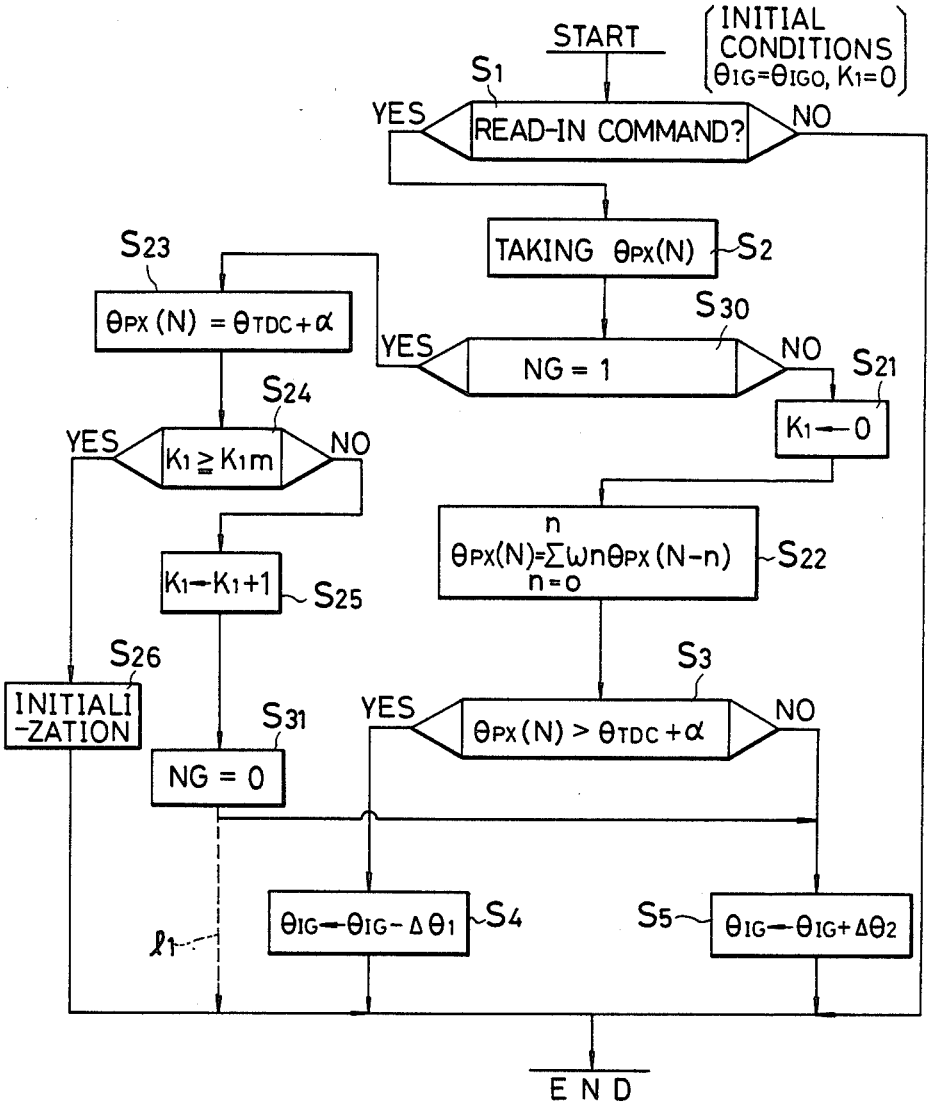
FIG. 12 is a flowchart showing program to be executed by a part of the system shown in FIG. 10.

FIG. 12 shows a program to be executed by the ignition angle establishing circuit 8 of the system shown in FIG. 10, which is the same as that of FIG. 9, except that the former includes a step $S_{30}$ in which it is determined whether or not a flag NG is equal to "1" while the flag NG is raised (NG=1) in another program (not shown) executed in concurrence with the program of FIG. 12 when the NG signal appears during a time period defined by two consecutive reference position pulses. The flag NG is cleared at step $S_{31}$ succeeding to the step $S_{25}$.

A hold circuit such as a flip-flop circuit may be provided for holding the NG signal until the appearance of the read-in command signal, if preferred.

What is claimed is:

1. In a feed-back control system for controlling an internal combustion engine in response to an indicative pressure signal representing the inner pressure of the combustion chamber of the engine, the improvement which comprises:

a reference position pulse generator for producing a reference pulse at each time when the crank angle of the engine reaches a predetermined reference position;

a first peak detector for producing a first peak signal when a maximum peak appears in said indicative pressure signal;

a filter for eliminating noises contained in said indicative pressure signal;

a second peak detector for producing a second peak signal when a maximum peak appears in the filtered indicative pressure signal; and comparing means for comparing the crank angle at which said first and second peak signals occur so as to produce an uncertainty detection signal when said first and second peak signals appear at different crank angles.

2. The improvement as defined in claim 1, in which said filter is a high-cut filter or a lowpass filter.

3. The improvement as defined by claim 1, in which said comparing means includes:

a counter counting the lapse of time from the reference position pulse;

a first latch circuit for latching the content of said counter in response to said first peak signal;

a second latch circuit for latching the content of said counter in response to said second peak signal; and comparing means for comparing the latched contents of said first and second latch circuits so as to produce said uncertainty detection signal when the latched contents are different each other.

4. The improvement as defined by claim 1, in which said first and secnd peak signals are first and second logic signals and said comparing means includes a logic circuit for producing said uncertainty detection signal when said first and second logic signals have a predetermined logical relation with each other.

5. The improvement as defined by claim 4, in which said first peak detector includes a first peak hold circuit for holding the maximum peak level of said indicative pressure signal during a crank angle region defined between two consecutive ones of the reference position pulses; and first comparator circuit for producing said first logic signal when said indicative pressure signal lowers in level below the held maximum peak level, and wherein said second peak detector includes a second peak hold circuit for holding the maximum peak level of said indicative pressure signal during a crank angle region defined between two consecutive ones of the reference position pulses, and a second comparator circuit for producing said second logic signal when the filtered indicative pressure signal lowers in level below the held maximum peak level.

6. An ignition timing control system for an internal combustion engine, comprising:

reference signal generating means for generating a reference position pulse every time when the rotational angle position of said internal combustion engine reaches a reference crank angle position;

indicative pressure signal generating means for generating an indicative pressure signal which is representative of the inner pressure in the combustion chamber of said engine;

peak position detecting means for detecting the maximum peak position of said indicative pressure signal during an interval between consecutive said reference position pulses so as to produce an indicative pressure peak position signal representing the maximum peak position in the crank angle of said engine during an engine cycle; and ignition angle establishing means for establishing an ignition angle at which said engine is to be ignited in a next engine cycle, in accordance with said indicative pressure peak position signal;

said peak position detecting means including, first peak detecting means for producing a first peak signal when a maximum peak appears in said indicative pressure signal, count means for producing a count value representative of a time period elapsed after each of said reference position pulses, filter means for filtering said indicative pressure signal so as to eliminate noises therefrom, second peak detecting means for producing a second peak signal when a maximum peak appears in the filtered indicative pressure signal, latch means for holding said count value developed by said count means at the issuance of said second peak signal, comparing means for producing an uncertainty detection signal when difference in crank angle positions of said first and second peak signals exists, read-in command signal generating means for generating a read-in command signal when said count value reaches a reference value, and determining means for determining the count value retained by said latch means as the maximum peak position datum in reponse to said read-in command while neglecting the maximum position datum in the case of appearance of said uncertainty signal during a corresponding one of the intervals.

7. An ignition timing control system according to claim 6, in which said determining means initializes its state upon a predetermined number of times of occurrence of said uncertainty signal.

8. An ignition timing control system according to claim 6, in which said filter is a high-cut filter or a low pass filter.

9. An ignition timing control system according to claim 6, in which said comparing means includes:

a counter counting the lapse of time from the reference position pulse;

a first latch circuit for latching the content of said counter in response to said first peak signal;

a second latch circuit for latching the content of said counter in response to said second peak signal; and comparing means for comparing the latched contents of said first and second latch circuits so as to produce said uncertainty detection signal when the latched contents are different each other.

10. An ignition timing control system according to claim 6, in which said first and second peak signals are first and second logic signals and said comparing means includes a logic circuit for producing said uncertainty detection signal when said first and second logic signals have a predetermined logical relation with each other.

11. An ignition timing control system according to claim 10, in which said first peak detector includes a first peak hold circuit for holding the maximum peak level of said indicative pressure signal during a crank angle region defined between two consecutive ones of the reference position pulses; and first comparator circuit for producing said first logic signal when said indicative pressure signal lowers in level below the held maximum peak level, and in which said second peak detector includes a second peak hold circuit for holding the maximum peak level of said indicative pressure signal during a crank angle region defined between two consecutive ones of the reference position pulses, and second comparator circuit for producing said second logic signal when the filtered indicative pressure signal lowers in level below the held maximum peak level.

12. An ignition timing control system according to claim 10, in which said ignition angle establishing means is adapted to prohibit the ignition during the next engine cycle upon the occurrence of said uncertainty signal.

13. An ignition timing control system according to claim 10, in which said ignition angle establishing means is adapted to retard the ignition timing at the next engine cycle upon the occurrence of said uncertainty signal.

* * * * *